United States Patent [19]

St. John

[11] Patent Number: 4,973,945

[45] Date of Patent: Nov. 27, 1990

[54] MAGNETICALLY LINKED THEFT SENSING SYSTEM

[76] Inventor: Havelin D. St. John, 17 Hart Ave., Trenton, N.J. 08638

[21] Appl. No.: 419,383

[22] Filed: Oct. 10, 1989

[51] Int. Cl.[5] ..... G08B 13/14

[52] U.S. Cl. ..... 340/571; 340/687

[58] Field of Search ..... 340/571, 568, 687, 551, 340/825.77, 538

[56] References Cited

U.S. PATENT DOCUMENTS

| | | | |
|---|---|---|---|
| 3,423,747 | 1/1969 | Hogencamp | 340/571 |
| 3,425,050 | 1/1969 | Tellerman et al. | 340/571 |
| 3,633,199 | 1/1972 | Curry et al. | 340/571 X |
| 4,121,201 | 10/1978 | Weathers | 340/687 X |
| 4,284,983 | 8/1981 | Lent | 340/568 |
| 4,327,360 | 4/1982 | Brown | 340/571 |
| 4,409,590 | 10/1983 | Baker | 340/538 X |
| 4,658,242 | 4/1987 | Zeder | 340/568 |
| 4,680,574 | 7/1987 | Ruffner | 340/571 |
| 4,736,195 | 4/1988 | McMurtry et al. | 340/568 |

*Primary Examiner*—Joseph A. Orsino
*Assistant Examiner*—Thomas J. Mullen, Jr.
*Attorney, Agent, or Firm*—William L. Muckelroy

[57] ABSTRACT

A theft sensing system which provides an output signal and actuation of an alarm upon cut off of its electrical power source. The system includes an oscillator which provides an output signal. The amplitude of the oscillator signal is modulated responsive to disconnection of an appliance from its power source. A signal level detector provides an output signal when the modulation amplitude varies beyond a predetermined level. The output signal from the level detector indicates disconnection of the appliance from a AC power source and is used to provide an alarm and permanently disable the appliance.

4 Claims, 3 Drawing Sheets

MAGNETICALLY LINKED THEFT SENSING SYSTEM

FIELD OF THE INVENTION

This invention relates to alarms, particularly magnetically linked alarm circuits for protection of household appliances relying on AC power input for operation.

BACKGROUND OF THE INVENTION

Ever since it has become apparent that the incidence of burglaries in private homes, especially burglaries and thefts of personal appliances such as televisions and VCRs, a multitude of alarms and alarm systems have been developed to thwart this problem. Alarms for protection of personal property from theft, for example in such places as museums and retail stores, have generally included some sort of plunger for sensing the removal of the object. See, for example, U.S. Pat. No. 4,274,088. The problem with this type of alarm as it relates to appliances in the home is that a thief can easily deactivate the alarm by keeping the plunger depressed while removing the appliance.

Another example is British patent No. 1,409,608 which discloses a loop alarm in which an electric circuit connected to an audible or visual alarm is located in a base on which articles are to be supported for display. A number of apertures are provided in the base within each which is located a light sensitive electrical component connected to the electric circuit. Articles on display are positioned over the light sensitive electrical components but if they are removed light is emitted to the component and actuates the alarm, Another British patent No. 1,600,798 provides an anti-theft device comprising an alarm module capable of producing a detectable alarm signal using a single electrical cable connected to the module to form a loop.

In 1974 U.S. Pat. No. 3,836,901 was issued to Matto et al, for a circuit and apparatus adapted to be mounted entirely or in part within the divece to be protected including an alarm circuit loop and a control loop with the state of the control loop being determined by whether the line cord of the protected device is in or out of the wall socket. The control loop can thus disable or enable the alarm circuit depending on the position of the power cord. However, actual operation of the alarm circuit requires both a change in the state of the control circuit due to the state of the line card and a change in the alarm circuit due to movement of the protected device. This type of arrangement does not allow or provide a mechanism to prevent the alarm from engaging as a result of momentary lapses in power to the appliance. This prior art device is operated utilizing a transformer.

A transformer is a rather heavy, expensive item which has unduly increased and made impractical the prior art line cord responsive alarm. The additional drawback of prior art line sensitive alarms is that they can not be easily adapted to present production lines. Moreover, the transformer alarm device has to be interconnected to the appliance and power input system.

SUMMARY OF THE INVENTION

In the new and novel system a key permits authorized personnel to remove an appliance when the line cord is disconnected. A bus is opened which removes the battery power that operates the alarm. The alarm and alarm enabling circuit are completely independent and it is only necessary that it be attached in such a way as to be in close proximity to a shunting inductor such that the shunting inductor generates a magnetic field which is either linked or coupled to a similar inductor comprising part of an oscillator circuitry.

It is an object of the present invention to provide an improved appliance antitheft system which detects unplugging of the appliance by altering magnetic linkage between two coupled inductors.

It is another object of the present invention to provide an anti-theft alarm system which senses a changing in magnetic field upon unplugging of the appliance and which provides an output signal upon unplugging which can be analyzed electronically in a variety of ways.

The foregoing and other objects of the invention are achieved by a theft alarm system including a tuned electrical circuit which is driven to oscillate at a frequency determined by the circuit components of the oscillator. A means responsive to unplugging of the appliance is coupled to the tuned circuit which serves to modulate the amplitude of the oscillations responsive to the unplugging of the appliance. Means are connected to receive the oscillator signal and provide an ouput signal when amplitude modulation exceeds a predetermined amount. The ouput signal is used to operate an associated alarm, relay or other circuit means such as a transmitter, for example.

The foregoing will be more clearly understood from the following description read in connection with the accompanying drawings, to wit:

Figure 1:
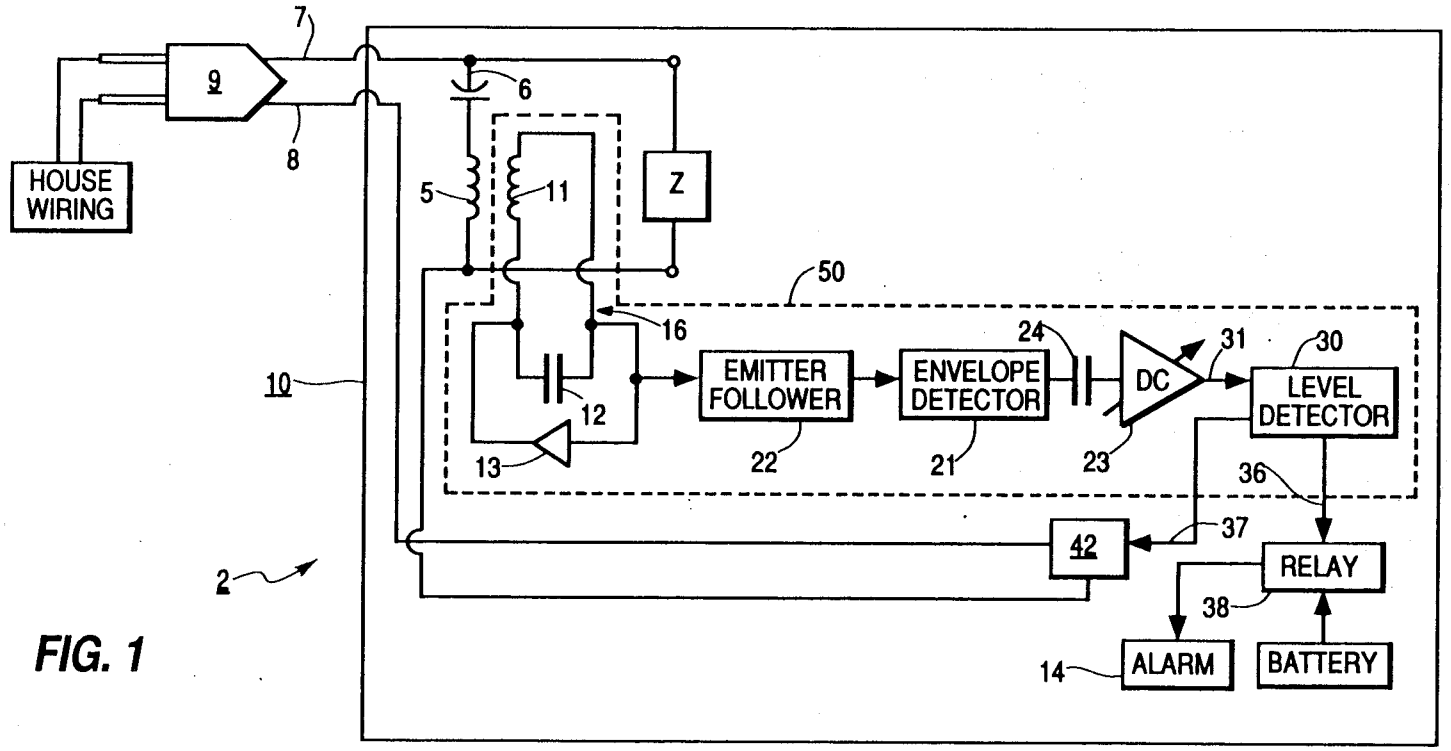
FIG. 1 is a block diagram of a novel anti-theft system for an appliance in accordance with the present invention.

Referring to FIG. 1 an appliance anti-theft system 2 includes an independent inductances 5 in series with a capacitance 6. The series circuit of the inductor 5 and the capacitance 6 is connected across leads 7 and 8 comprising an electrical cord connected to an AC plug 9. An appliance 10 exhibits an electrical load Z connected across the leads 7 and 8.

Figure 2:
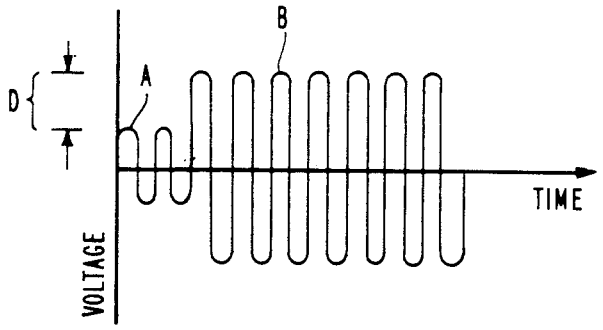
FIG. 2 shows typical signals from the circuit shown in FIG. 1.

Referring to FIG. 2 the appliance anti-theft system 2 also includes an alarm 14 and an independent tuned circuit 16 comprising another inductance 11 and a capacitance 12. An amplifier 13 is connected to the tune circuit 16 to supply power and cause the circuit 16 to oscillate at a predetermined frequency f dependent upon the values of the inductance 11 and capacitance 12. The amplifier 13, as will be presently described, is a current limiting amplifier so that it operates as a current source to supply substantially constant power to the tuned circuit 16 so that the ciruit 16 normally operates at a predetermined amplitude A, referring to FIG. 2.

The first inductance 5 is disposed in such a manner and mounted substantially parallel to axis of the coil forming the inductance 11 such that the magnetic field induced in the inductance 5 couples with the magnetic field in the inductance 11. A change in the magnetic field induced in the inductance 5 will cause variable losses in the tuned circuit 16 and change the amplitude A of the voltages across the tuned circuit 16. This amplitude change is graphically illustrated in FIG. 2. The normal oscillating amplitude is A, the change in oscillations shown indicates a change in the magnectic coupling between the inductance 5 and the inductance 11. The change is introduced as a result of the plug 9 being disconnected from an AC power source (not shown). Thus, during normal quiescent operation the oscillations will have one value such as A while upon unplugging the appliance 10 what happens is that the oscillator circuit provides a changed amplitude of oscillation such as B, for example, referring to FIG. 2.

Again referring to FIG. 1 an envelope detector 21 connected to the oscillator 16 via an emitter follower 22. The envelope detector 21 does not load the tuned circuit 16. The envelope detector 21 receives an amplitude modulated oscillation, as shown in FIG. 2, and provides a varying direct current (DC) output signal and is capacitively coupled by a capacitor 24 to a DC amplifier 23. An output of the amplifier 23 is a variable voltage 31 which corresponds to the change in the magnetic field coupling between the inductance 11 and the inductance 5. The varying output voltage 31 from the amplifier 23 is supplied to a level detector 30 which can comprise a pair of comparators, for example, set high and low limits to accomodate for a change of the output voltage 31 of the amplifier 23 as indicated by the amplitude difference D of the signal as shown in FIG. 2.

When the voltage is outside of the amplitude A the circuit 16 in combination with the level detector 30 considers that a disconnection of the AC line power source has occurred and will provide an output signal 36. The signal 36 can then be directed via relay 38 to drive a suitable alarm 14, such as a horn, lights, etc. or another signal 37 may be used to drive a normally closed relay circuit 42 to deactivate power to the load permanently.

Figure 3:
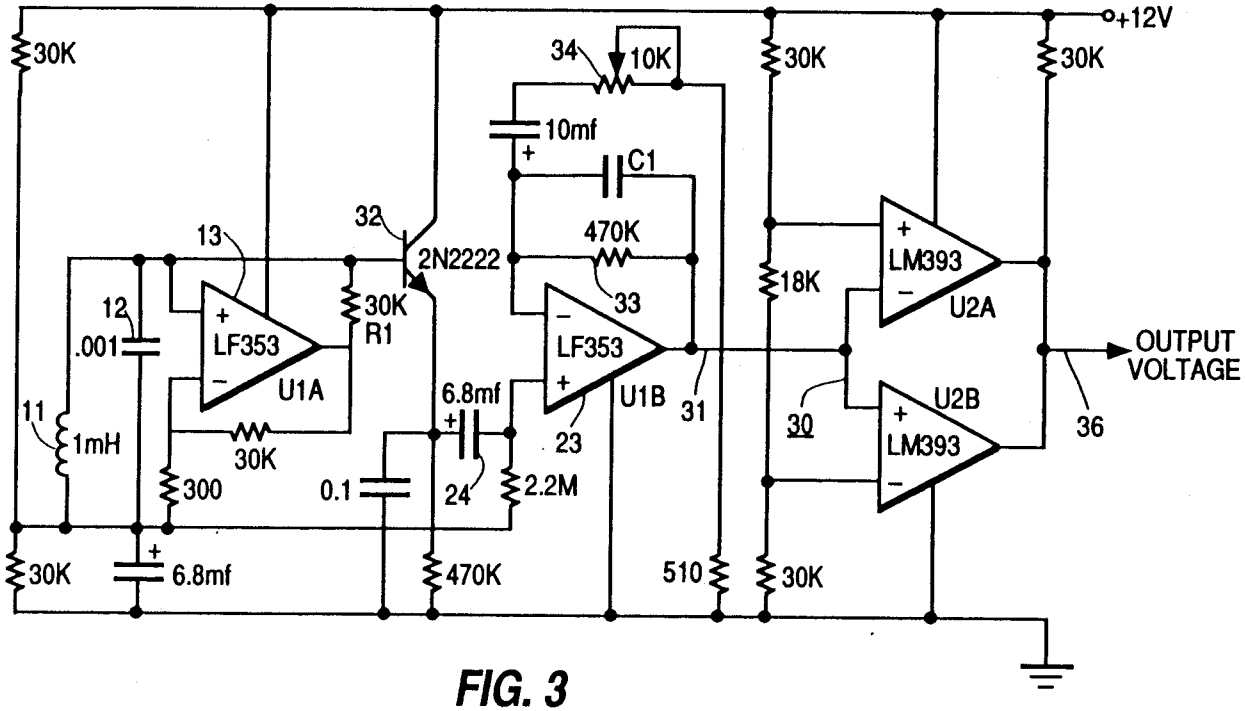
FIG. 3 is a detailed circuit diagram of the part of the system shown in FIG. 1 enclosed in dotted lines.

FIG. 3 is a detailed circuit diagram of one embodiment the part of the present invention enclosed in dotted lines 50 designed to provide upon disconnection of the plug substantially changed output voltages, namely variable voltage 31. The output voltage is +12 volts for plugged inactive status, for example. When the anti-theft detector senses an unplugging of the appliance the output voltage is changed measurably. The component values used in the circuit are shown in the drawing, FIG. 3. The amplifiers U1A and U1B are LF 353. The dual operational amplifiers U2A, U2B are LN393 comparators, for example.

Referring to FIG. 3 again, operational amplifier U1A and associated components form amplifier 13 for driving the tuned circuit 16 comprising the inductance 11 and capacitance 12. The output from the operational amplifier 13 is shown fed to the tuned circuit 16 through resistor R1 to provide oscillations. The resistor R1 is selected to make the U1A amplifier 13 look like a current source. The voltage associated with the coil 11, increases as the inductor 5 (FIG. 1) experiences a decrease in its magnetic field due to a disconnection. The losses in the tuned circuit 16 are at a maximun as illustrated at B, (FIG. 2). Although the oscillating frequency of the circuit 16 is not critical in this example it may be said to be about 160 kiloHertz, for example, for the convenience of using a reasonable size component in the associated circuitry. The amplifier U1A operates at its maximum output to provide a constant drive to the circuit as shown in FIG. 3.

The transistor 32 is connected as the emitter follower 22 (FIG. 1) which provides an output signal having an amplitude corresponding to the envelope of the oscillator signal for the DC amplifier 23 including U1B and associated components. The output of the amplifier 23 is a slow, varying DC voltage about 100 times larger than the output of the envelope detector 21. The capacitor C1 and resistor 33 provide a feedback circuit for the amplifier 23 so that it does not respond to detector ripple or other interference in the AC line which might be picked up by the high impedence of the envelope detetor 21. The gain of the amplifier 23 can be adjusted with potentiometer 34.

The output from the amplifier 23 is applied to the level detector 30. The level detector 30 comprises dual comparators U2A and U2B. In the present example when the variable voltage 31 goes substantially below 4.62 volts or above 12 volts, for example, the output comparators U2A and U2B are driven to ground potential. In such condition the output voltage 36 is grounded.

The grounded output voltage 36 is used to trigger associated circuits such as relays 38 and 42, to set off an intrusion alarm, light or other associated alarm system or to disengage the internal circuitry 16.

Thus it is seen that there has been provided a novel detector which operates independently of the quiescient position of the theft detector and which provides an output when there is a disconnection of the appliance.

What is claimed is:

1. In a household appliance operable on an AC power cord disconnectable from a house wiring circuit, the improvement comprising a theft protection apparatus located inside said appliance, said apparatus having means for determining a disconnection of said appliance from a circuit comprised of said house wiring, said AC line cord connected to said wiring, and a first inductor in series with a capacitor shunted across said AC line cord.

2. The theft protection apparatus of claim 1 wherein capacitor and said first inductor are located inside said appliance.

3. The theft protection apparatus of claim 2 wherein said means for determining disconnection of said appliance comprising a circuit oscillator having an output, said oscillator having a second inductor therein magnetically coupled to said first inductor wherein the amplitude of said output is altered upon disconnection.

4. A device for detecting a theft of a household appliance having a line cord connected to an AC output source comprising a oscillator including a tuned circuit providing oscillations, a first inductance means shunted across said AC line cord in said appliance, said first inductance means being magnetically coupled to said tuned circuit, means for modulating the amplitude of the oscillations of said oscillator responsive to changes in a magnetic flux produced by said first inductance means, means connected to said oscillator to receive a voltage output related to the oscillations and to provide an output signal when the amplitude modulation of the oscillations exceeds a predetermined envelope.

* * * * *